United States Patent [19]

Laird

[11] 4,242,715

[45] Dec. 30, 1980

[54] SELF-DEFENSE APPARATUS

[75] Inventor: Gerald Laird, Indianapolis, Ind.

[73] Assignee: Ultradyne, Inc., Norristown, Pa.

[21] Appl. No.: 932,539

[22] Filed: Aug. 10, 1978

[51] Int. Cl.[3] ..... F41B 15/04

[52] U.S. Cl. ..... 361/232; 231/2 E; 273/84 ES

[58] Field of Search ..... 361/232; 273/84 ES; 231/2 E; 128/405

[56] References Cited

U.S. PATENT DOCUMENTS

| | | | |
|---|---|---|---|
| 765,926 | 7/1904 | Kelly | 272/27 R |
| 1,046,985 | 12/1912 | Creedon | 128/800 |
| 1,454,528 | 5/1923 | Wiemann | 128/796 |
| 1,915,721 | 6/1933 | Diaz | 361/232 |
| 3,362,711 | 1/1968 | Larson et al. | 272/84 ES |
| 3,523,538 | 8/1970 | Shimizu | 128/785 |
| 3,599,860 | 8/1971 | Huwaldt . | |
| 3,722,788 | 3/1973 | Petrecz | 231/2 E |
| 3,819,108 | 6/1974 | Jordan | 273/84 ES |
| 3,845,771 | 11/1974 | Vise | 128/303.13 |
| 3,885,576 | 5/1975 | Symmes | 131/170 A |
| 3,998,459 | 12/1976 | Henderson et al. | 361/232 X |
| 4,006,390 | 2/1977 | Levine | 361/232 |
| 4,120,305 | 10/1978 | Rhoads et al. | 361/232 X |
| 4,162,515 | 7/1979 | Henderson et al. | 361/232 |

*Primary Examiner*—J. D. Miller
*Assistant Examiner*—L. C. Schroeder
*Attorney, Agent, or Firm*—Woodard, Weikart, Emhardt & Naughton

[57] ABSTRACT

A self-defense apparatus includes a battery-powered source of high voltage arranged in an insulated housing and a finger probe device which is strapped to one finger of one hand of the user and is electrically connected to the source of high voltage. The finger probe device includes a layer of electrical insulation disposed between the finger and two metal prongs which protrude outwardly adjacent the distal end of the finger. One prong couples to the hot side of the source of high voltage and the other prong couples to the ground side of the source of high voltage. A two conductor cable connects the two prongs to the source of high voltage and when both prongs are placed in contact with an electrically conductive surface, they deliver in excess of 1,200 volts.

10 Claims, 12 Drawing Figures

SELF-DEFENSE APPARATUS

BACKGROUND OF THE INVENTION

This invention relates in general to electrical devices and in particular to such devices which are designed to deliver high voltage to the location of the hands from a remote source.

Electrical devices which are designed to deliver a voltage potential from a remote location to the area of the hands are not new. For example, a typical devices which fall into this broad descriptive category are electric gloves. Similarly, the generation of high voltage potential from a low-voltage battery source is known, and representative of this type of device are such items as crowd-control sticks and cattle prods. The following list of patents provides some indication of further electrical designs which have been conceived and which pertain at least in part to the two general categories mentioned above.

| Patent No. | Patentee | Issue Date |
|---|---|---|
| 1,046,985 | Creedon | 12/10/12 |
| 3,885,576 | Symmes | 5/27/75 |
| 765,926 | Kelly | 7/26/04 |
| 3,523,538 | Shimizu | 8/11/70 |
| 1,454,528 | Wiemann | 5/08/23 |
| 1,915,721 | Diaz | 6/27/33 |
| 3,362,711 | Larson et al. | 1/09/68 |
| 3,599,860 | Huwaldt | 8/17/71 |
| 4,006,390 | Levine | 2/01/77 |
| 3,998,459 | Henderson et al. | 12/21/76 |
| 3,819,108 | Jordan | 6/25/74 |
| 3,722,788 | Petrecz | 3/27/73 |
| 3,845,771 | Vise | 11/05/74 |

Creedon discloses an electrical device which includes a belt to be worn about the waist and a pair of gloves provided with electrodes located in the palm portion of the gloves. The device relies on grasping pressure to close a spring contact in order to deliver a voltage potential to the electrodes.

Symmes discloses a wrist band and mercury switch combination which are arranged so that when the person raises his arm to put a cigarette to his lips, the mercury switch closes to connect a source of power and induce an electrical shock in the person in order to deter the person from smoking.

Kelly discloses an electrical toy which includes a small dry cell battery in series with an induction coil and a pair of buttons disposed at the proximal end of a finger of the user which when placed in contact with a conductive object, such as another person's hand, will deliver a low-level electrical shock.

Shimizu discloses a device for subduing a criminal which includes a projectile having two needle electrodes which have different potentials and are adapted to pierce the skin, means for propelling the projectile at the criminal, and a supply of electric current connected to the electrodes.

Weimann discloses a magneto electric shocking machine which includes a pair of electromagnets and a four-pole rotor. The machine is hand-held and may be thumb controlled to set up an alternating current in the windings.

Diaz discloses an electric glove design wherein the gloves carry electric contacts which are connected to a source of current. The source of current is carried by the wearer of the glove and the wearer of the glove may inflict an electric shock on another person by bringing the contacts into engagement with the other's body.

Larsen et al. discloses a night stick with electric shock means wherein a battery-powered, voltage-generating circuit is disposed within a tubular night stick and the circuit is electrically coupled to two bare electrical contacts positioned exterior at one end of the night stick.

Huwaldt discloses an electric shock device with a yoke-shaped support member conformable to fit within the palm of the hand and which is arranged to releasably hold a dry cell battery between its spaced arms. A pair of electrodes project from the support member which are operatively associated in a circuit with the battery to selectively short circuit electric energy provided by the battery by pressing the electrodes against the body of an animal which results in a shock.

Levine discloses a nonlethal weapon for providing high-voltage electrical shocking potential. When not in use, the weapon is contracted or collapsed into a small size for conveniently carrying it in the pocket or purse, and is rapidly put into active use by triggering the extension of an elongatable probe carrying the high voltage contacts.

Henderson et al. discloses an electrical shocking device which includes a manipulatable tubular housing, one end of which is open and provided with a flange. A plastic tube is movably positioned within the housing against the flange. The plastic tube contains an electric circuit, including a spark gap and circuit members for converting a low direct voltage into a high voltage, storing a high voltage charge and intermittently discharging the storage device. A pair of probes extend outwardly from the tube beyond the flange, those ends of the probes within the tube being connected to opposite ends of a charge-storing capacitor through a spark gap in series with one of the probes.

Jordan discloses an electric shock weapon for use by officers in maintaining order at public gatherings and for other crowd-control applications. The invention is embodied in an electrified stick or in an electrified garment worn by the user. The device comprises at least one pair of exposed conductors which are connected across a high-voltage power supply and adapted to be simultaneously engaged with the anatomy of a would-be assailant and thus to ward off or cause retreat of such person.

Petrecz discloses an electric shock-protective device having a circuit with a vibrating coil and high-voltage prods telescopingly positioned on a compact housing having the battery power supply and the vibrating current therein.

Vice discloses a glove for use in electrosurgical and/or electrocauterization procedures which includes a flexible electrode integrally carried on the volar surface of at least one of the digits of the glove and electrically connected to one end of an electrically insulated, remotely extending, flexible lead, and through which relative high-frequency electrical current may be passed to an electrically conductive instrument grasped in the glove hand of the surgeon and thence directly to the tissue to be cauterized or otherwise treated.

While these various devices may have provided certain novel improvements at the time of their conception, the circumtances of today with respect to a person protecting himself or herself, dictate certain requirements for any suitable self-defense apparatus and the designs disclosed by the listed patents which pertain to self-defense devices do not satisfy these requirements.

First of all, in order to have public acceptance and a willingness to use the device, a self-defense device needs to be lightweight, portable, affordable, easily worn and easily concealed, comfortable and able to be used by anyone without having to learn a particular technique. Although the electrical effectiveness of a device (i.e., how much voltage can be delivered in order to shock) may not require all of these listed features, a primary consideration is the ease of operation and the convenience to the user. If a person is reluctant to wear a device because it is uncomfortable or unattractive, then regardless of how effective it might be, if it is not going to be worn, it will not be effective. Another consideration is in what manner the electrical shock is delivered. Devices which provide two rounded electrodes and require the would-be assailant to be contacted on his skin may prove ineffective if the user is attacked from behind and cannot find or otherwise make contact with the skin of the assailant. To be effective, a device must be able to penetrate through at least one layer of clothing so that a shirt sleeve or pant leg could be contacted and still establish the requisite electrical contact in order to deliver a high-voltage shock to the assailant.

Devices which involve the wearing of gloves are not convenient on warm days or inside buildings and devices which employ a bulky power pack are not convenient for women wearing dresses. Furthermore, devices which are carried separate from the body of the user, such as a night stick or cattle prod, involve some degree of skill and possibly a particular technique in order to use the device properly, and if the user is not proficient in the use of the device, the user may be easily disarmed by an assailant. Devices which involve the delivery of a projectile or missile are only as effective as the aim of the user and these devices do not provide the advantages of positive and direct contact with the assailant as well as rapid refiring or reuse. Another consideration involves the factors of cost, simplicity of design and ease of manufacturing. It is important to the acceptance and widespread use of such devices that they be available at a cost which is affordable by a majority of individuals. Therefore, an effective device is one which incorporates manufacturing efficiencies and a minimum of component pieces in order to keep the cost at an affordable level without compromising the electrical effectiveness and the reliability of the device.

SUMMARY OF THE INVENTION

A self-defense apparatus according to one embodiment of the present invention comprises a source of high voltage and a finger probe device electrically coupled to the source of high voltage. The finger probe device includes means for attaching the finger probe device to a finger and a plurality of electrically conductive, outwardly protruding prongs.

One object of the present invention is to provide an improved self-defense apparatus.

Another object of the present invention is to provide a self-defense apparatus which is lightweight and may be conveniently worn by the user.

Related objects and advantages of the present invention will be apparent from the following description.

DESCRIPTION OF THE PREFERRED EMBODIMENT

Figure 1:
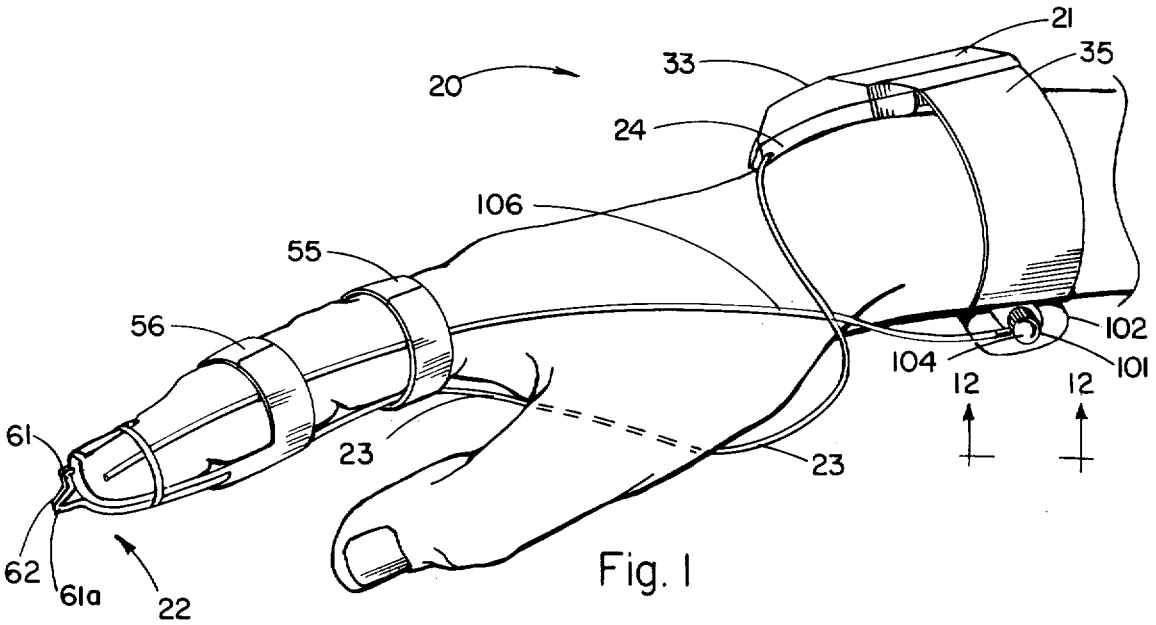
FIG. 1 is a perspective view of a hand and wrist on which a self-defense apparatus is being worn, according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, there is illustrated a portable self-defense apparatus 20 which is oriented on the hand and wrist as it would be when worn by the user and ready for use. Apparatus 20 includes a main body unit 21, a finger probe device 22 and a two-conductor cable 23 which electrically connects the finger probe device 22 to the main body unit 21.

Figure 3:
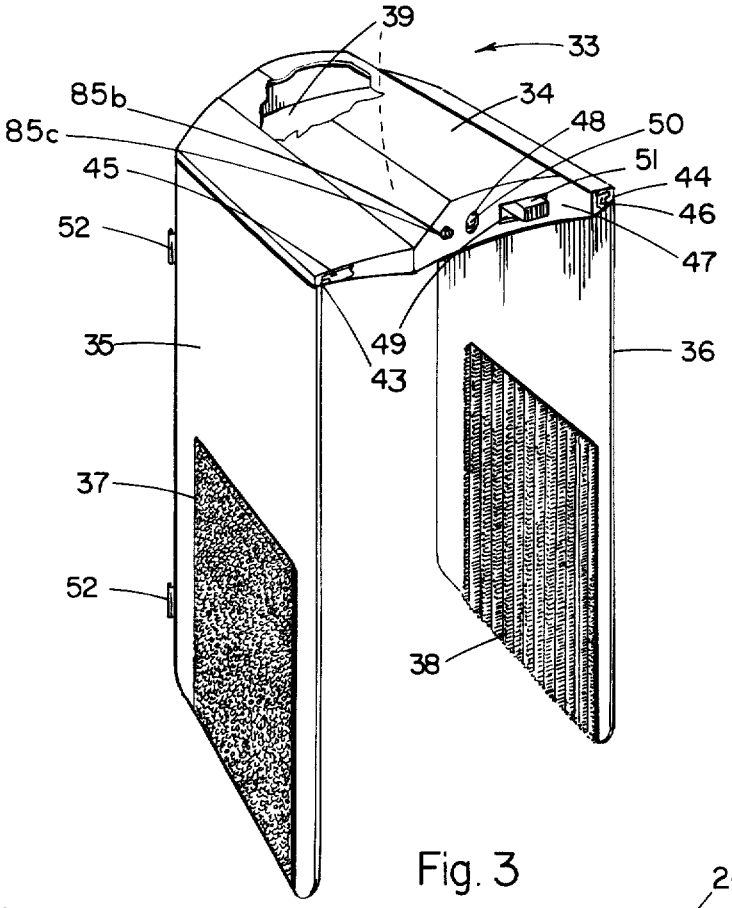
FIG. 3 is a perspective view of top section of a main body unit comprising a portion of the FIG. 1 self-defense apparatus.
Figure 2:
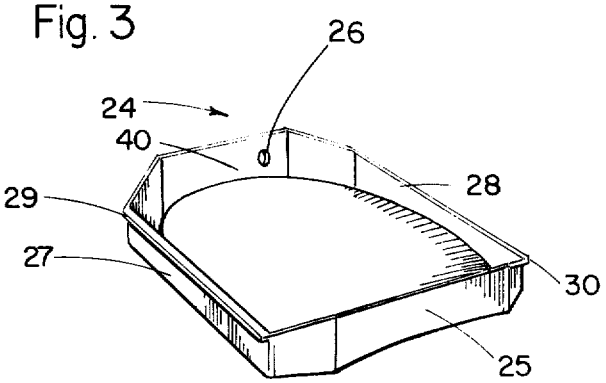
FIG. 2 is a perspective view of a base unit of a main body unit comprising a portion of the FIG. 1 self-defense apparatus.

Main body unit 21 includes a two-piece, electrically insulated housing and wrist strap combination and a high-voltage circuit which is positioned within the housing. The base unit 24 of the housing is illustrated in FIG. 2 and comprises a receptacle type of unit which is generally square in exterior appearance, though relative shallow, and has a slightly concave underside so as to readily conform to the slight convex curvature of the human anatomy in the area of the wrist. Base unit 24 includes an inlet aperture 26 at one end for the entry of cable 23 which is hard wired to the high-voltage circuit as will be described hereinafter. The two side walls 27 and 28, which are spaced apart, yet substantially parallel to each other, extend in a direction which is generally normal to the plane of front wall 25. Disposed along the uppermost edge of each side wall 27 and 28 is a longitudinally extending, outwardly protruding lip 29 and 30, respectively. Lips 29 and 30 which extend beyond their respective side walls by approximately 0.03 inches have a slight downward and outward taper and provide snap-together interlock means for the joining of base unit 24 to top section 33 (see FIG. 3) as will be described in greater detail hereinafter. Base unit 24 may be constructed from any one of a number of electrically insulating, thermosetting or thermoforming plastic compounds, and it is preferred that base unit 24 be molded as a single piece. The exterior shape of base unit 24 may be rectangular, square, circular or irregular so long as its periphery shape is compatible with that of top section 33 so that when snapped together, the two parts will create a sealed enclosure wherein the high-voltage circuit can be located and protected from mechanical as well as environmental damage.

Top section 33 includes a top housing portion 34 and oppositely disposed, mutually engageable straps 35 and 36 which are flexible in design and of suitable length to extend around the wrist. Disposed on the outer surface of strap 35, adjacent the free end, is a region of loop-like, randomly arranged synthetic fibers 37 and disposed on the inner surface of strap 36, adjacent the free end, is a corresponding region of hook-like, synthetic projections 38. The length of straps 35 and 36 is sufficient to place fibers 37 and projections 38 in an overlapping arrangement to each other and fibers 37 and projections 38 are suitably designed to lockingly engage each other and to secure main body unit 21 to the wrist, or to any other suitable appendage where main body unit 21 may be worn. For example, by lengthening straps 35 and 36, main body unit 21 may be attached about the upper arm or about a leg.

Top housing portion 34 is of a dome-like lid or top design which provides an open region 39 between its various side walls and surfaces for enclosing portions of the high-voltage circuit. In fact, it is open region 39 which combines with open region 40 of base unit 24 in order to provide the necessary clearance for the packaging of the high-voltage circuit. Although top section 33 is illustrated as a uniquely shaped and contoured unit, it is to be understood that so long as adequate clearance is provided for packaging the high-voltage circuit, and so long as top section 33 and base unit 24 are similarly shaped at their engaging and abutting edges to provide an enclosed space, the exact exterior shape of top section 33 may vary.

Figure 4:
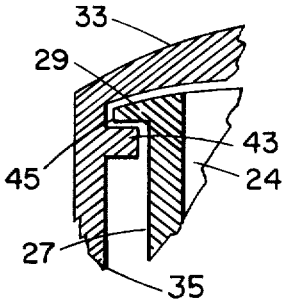
FIG. 4 is a partial detailed view of the engagement between the FIG. 2 base unit and the FIG. 3 top section.

The interior longitudinal edges which extend widthwise across straps 35 and 36 and which correspond to the interface line between straps 35 and 36 and top section 33 are uniquely shaped with inwardly protruding taps 43 and 44 and corresponding recess 45 and 46, respectively. Lips 29 and 30 on base unit 24 are similarly shaped and sized with recesses 45 and 46 on top section 33 such that base unit 24 and top section 33 can be easily snapped together (see FIG. 4), and once assembled, the two pieces will not be subject to unintentional or inadvertent separation. The rear face 47 of top housing 34 includes clearance apertures 48 and 49 for light 50 and ON/OFF switch 51, respectively, which are included as part of the high-voltage circuit. Similar to base unit 24, top section 33, with the exception of fibers 37 and projections 38, may be molded as a single-piece unit from a suitable thermoforming or thermosetting plastic compound. It is also possible as part of such molding process to structure the two edge interface lines between straps 35 and 36 and top housing portion 34 as a living hinge, so that main body unit 21 may be more easily secured in place around the corresponding appendage onto which unit 21 is worn. With such a molding process, it is also possible to provide as part of either strap a series of tubular wire-retaining clips 52 which may be used to retain the cable 23 when the finger probe device 22 is removed from the finger or when there is excess cable length which would otherwise hang loose. It is also possible to allow main body unit 21 to remain in place and only remove finger probe device 22. When this is done, clips 52 may be used to hold cable 23 and the finger probe device 22 may be tucked under straps 35 and 36 or under base unit 24. This type of temporary storage is to be preferred for short intervals of nonuse, rather than removing the entire apparatus.

Figure 5:
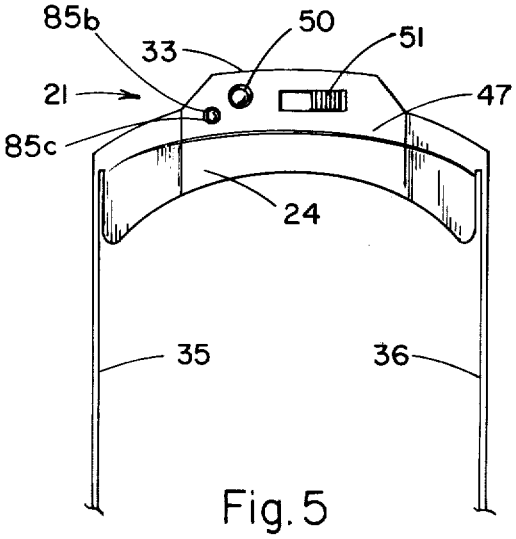
FIG. 5 is a rear elevation view of a main body unit comprising a portion of the FIG. 1 self-defense apparatus.

Referring to FIG. 5, top section 33 and base unit 24 are illustrated in their snapped-together position wherein they comprise main body unit 21. It can be seen that the general configuration of unit 21 is similar to a digital watch and, since the overall thickness of unit 21 in a vertical direction is approximately 0.75 inches (19.1 mm), unit 21, when attached to the wrist, can comfortably be worn beneath a shirt or sweater. It is also possible to replace straps 35 and 36 with other attaching and securing means such as a leather strap and buckle arrangement or an expansion band of the type typically associated with watches. Of course, if such a change is made, top section 33 would be redesigned in order to provide anchoring means for such alternative attaching and securing means.

Figure 6:
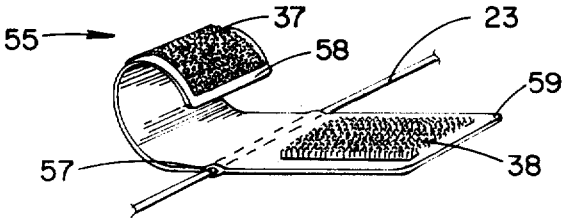
FIG. 6 is a perspective view of a finger strap comprising a portion of the FIG. 1 self-defense apparatus.

As previously mentioned, main body unit 21 electrically couples to finger probe device 22 by means of a two-conductor cable 23. It is important to the wearing convenience of apparatus 20, that cable 23 be routed from the wrist to the finger in such a way that the cable will not loosely hang while still remaining comfortable and if possible, out of sight. To aid in accomplishing these objectives, finger straps 55 and 56 are provided at spaced apart locations along the length of the finger and each strap is similarly constructed. Finger strap 55 is illustrated by FIG. 6 and the following description is to be understood to apply equally to both finger straps 55 and 56. Finger strap 55 may be fabricated of a flexible vinyl plastic and molding is preferred so that cable passageway 57 can be molded in as part of strap 55. It is also possible to mold straps 55 and 56 around cable 23, and if cable 23 is provided with a TEFLON outer jacket, mold release will not be necessary in order to permit cable 23 to adjustably slide back and forth through cable passageway 57. In this manner, the length of cable 23 may be infinitely adjusted between finger strap 55 and main body unit 21, and this permits finger strap 55 to be positioned at any one of a number of locations along the finger. Overlapping ends 58 and 59 of finger strap 55 are equipped with small strips of fibers 37 and projections 38, whose function has been previously described, so that strap 55 may be easily applied and secured in place. In lieu of fibers 37 and projections 38, ends 58 and 59 of finger strap 55 may be joined together by means of metal or plastic snaps or by means of an adjustable strap and buckle arrangement.

Figure 7:
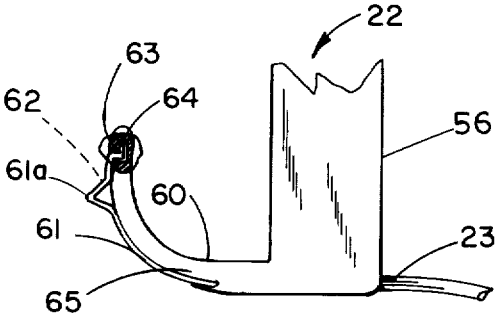
FIG. 7 is a side elevation view of a finger probe device which comprises a portion of the FIG. 1 self-defense apparatus.
Figure 8:
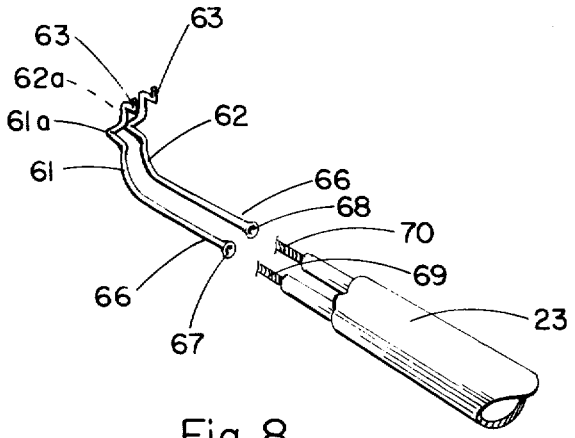
FIG. 8 is a perspective view of the electrical connection of two metal prongs to a cable, the prongs and cable comprising portions of the FIG. 1 self-defense apparatus.

Although finger straps 55 and 56 have been described as being substantially the same, finger strap 56 also includes a layer 60 of electrical insulation, which may be, for example, the same flexible vinyl plastic from which straps 55 and 56 are molded. Layer 60 may be joined to strap 56 as a separate piece or may be molded integral with finger strap 56. Finger probe unit 52 (see FIG. 7) which includes strap 56 and layer 60 also includes a pair of electrically conductive, metal prongs 61 and 62 which are disposed along the outer surface of layer 60, laterally across the end of the finger, and protrude outwardly therefrom at their outermost location for a distance of approximately ⅛ of an inch (3.2 mm). Prongs 61 and 62 are substantially parallel to each other and are spaced apart a distance of approximately 0.25 inches (6.4 mm). This distance of separation is sufficient to enable the prongs to carry a potential difference of at least 1,200 volts D.C. without arcing across. Prongs 61 and 62 are each shaped so that each outwardly protruding portion 61*a* and 62*a* has a slightly rounded, yet pointed contour, suitable for penetrating a single layer of clothing. The uppermost end 63 of each prong is inset within a small cavity 64 in the outer surface 65 of layer 60 and consequently, prongs 61 and 62 may be removed from layer 60 for repair or replacement. The opposite ends 66 of prongs 61 and 62 are fitted with suitable means for the coupling of two-conductor cable 23, such as, for example, solder cups 67 and 68 (see FIG. 8). By stripping the jacket and conductor insulation, conductors 69 and 70 may be attached to prongs 61 and 62 such as by soldering or crimping. Once this assembly step is completed, the cable is able to be pulled back through the passageway in strap 56 as ends 63 are placed in their corresponding cavities 64. By pulling cable 23 taut and securing finger straps 55 and 56, prongs 61 and 62 will remain firmly fixed in position. It is preferred for the vinyl plastic, or other suitable material, which is used for finger straps 55 and 56 and for layer 60, to be substantially transparent so that the finger probe unit 22 can be somewhat camouflaged when worn on the hand. A suitable material thickness for these vinyl plastic members is approximately 1/64 of an inch and this thin of material, in combination with the lightweight molded construction of main body unit 21, contributes to the overall light weight and wearing comfort of apparatus 20. The total weight of apparatus 20, including the high-voltage circuit, is less than one pound.

Figure 10:
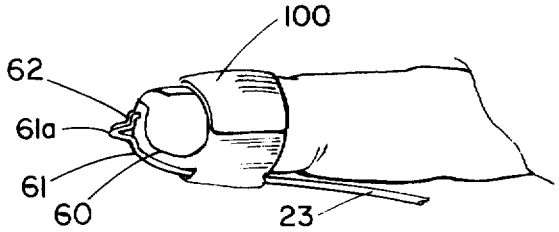
FIG. 10 is a partial, side elevation view of an alternate finger strap design suitable for use with the FIG. 1 self-defense apparatus.

Depending upon the size of the particular finger, stability to the end of the finger probe device 22 may be increased by utilizing a finger sleeve 100 (see FIG. 10) between the end of the finger and the first finger joint. Finger sleeve 100 is wider than finger strap 55 (or 56) and includes synthetic fibers 37 and projections 38 arranged so that the length of the sleeve is adjustable. Sleeve 100 also includes a corresponding layer 60 and is fitted with prongs 61 and 62 which are coupled to main body unit 21 by means of cable 23.

Figure 11:
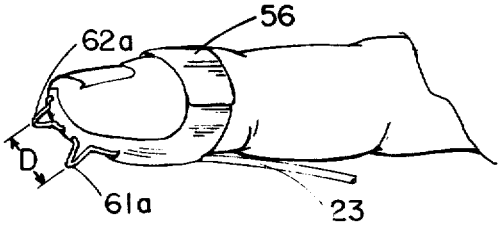
FIG. 11 is a partial, side elevation view of an alternate finger probe design suitable for use with the FIG. 1 self-defense apparatus.

Prongs 61 and 62 have been described and illustrated (see FIGS. 1 and 8) as being generally parallel to each other, disposed at the outer end of the finger and being spaced apart laterally across the end of the finger. However, at voltage levels such as 1,200–1,500 volts a requisite minimum spacing between prongs is necessary in order to prevent arcing. In certain instances it may be desirable to orient the prongs longitudinally along the long axis of the finger (see FIG. 11) rather than laterally. This arrangement is preferred when finger width is not sufficient to achieve the requisite minimum spacing, D, in order to prevent arcing. The locating of the prongs along the long axis of the finger provides a greater range of positioning options and more surface area for locating.

Figure 12:
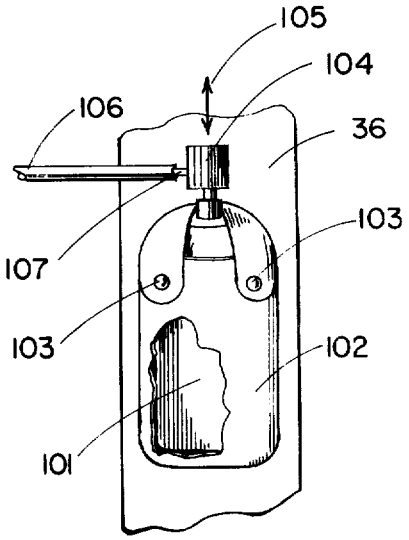
FIG. 12 is a plan view of a repellant aerosol cannister and pouch comprising a portion of the FIG. 1 self-defense apparatus as taken along line 12—12 in FIG. 1.

Another feature of self-defense apparatus 20 is that a supplemental self-defense means is provided by aerosol cannister 101 (see FIGS. 1 and 12) which is filled with a repellant such as, for example, mace or tear gas. Cannister 101 is of a miniature size with respect to conventional aerosol containers, but operates in a manner identical to that of conventional aerosols. Cannister 101 is retained in pouch 102 which is secured to strap 36 and located on the underside of the wrist. Pouch 102 may be secured to strap 36 by sewing or by snaps or by other suitable means such that pouch 102 cannot be shook or jarred loose. Pouch 102 is designed similar to a canteen pouch and includes two top flaps which fold over to surround the top of the cannister around its outlet and these flaps are retained to the remainder of the pouch by snaps 103. Cannister 101 includes a pushbutton 104 which activates the spraying of the repellant from the cannister by depression of pushbutton 104 toward the cannister in the direction of arrow 105. Also included as part of this supplemental self-defense means is a length of flexible tubing 106 which is pressed over stem outlet 107 of cannister 101 and extends from the cannister, along the side of the hand, to a location adjacent the outermost end of the finger on which finger probe device 22. Tubing 106 is secured to the finger by finger straps 55 and 56. Depending upon the rigidity of the tubing 106, a third securing point may be desirable. This is accomplished by placing a small rubber band or similar item around the tubing and the end of the finger. This third securing point may also be achieved by the use of finger sleeve 100 with tubing 106 routed between the sleeve and the finger. In order to release the repellant in spray form from the outermost tip of the finger, the opposite hand of the user is utilized to depress pushbutton 104. Although cannister 101 measures only approximately 1.50 inches (38.1 mm) by 0.50 inches (12.7 mm) by 0.37 inches (9.4 mm), sufficient repellant is retained therein, under pressure, in order to deliver at least three doses of spray, each does being sufficient to temporarily disable a would-be attacker.

Figure 9:
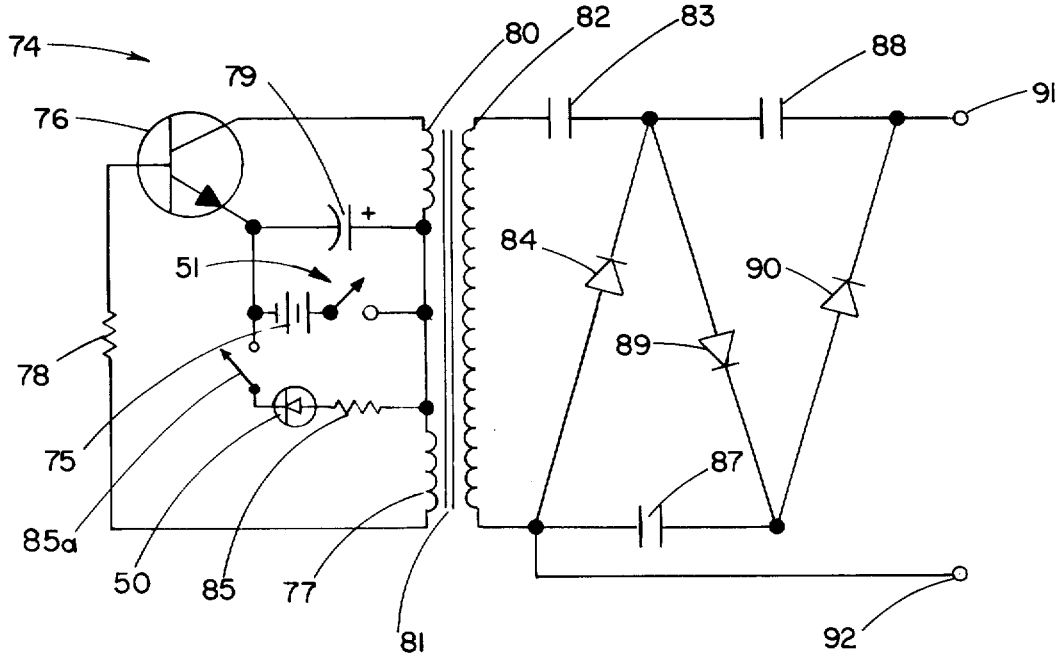
FIG. 9 is a schematic diagram of a high-voltage circuit comprising a portion of the FIG. 1 self-defense apparatus.

As previously mentioned, a high-voltage circuit is enclosed within main body unit 21 and the schematic representation of this high-voltage circuit 74 is illustrated in FIG. 9. Circuit 74 is controlled by ON/OFF switch 51 which extends through the front face 47 of top housing portion 34. When switch 51 is closed, battery 75 places a positive voltage on the base of transistor 76 by way of feedback coil 77 and resistor 78. Transistor 76 also receives current from battery 75 at its emitter which passes through to the collector of transistor 76. At the same time, a small amount of current leaves the base of transistor 76 and is developed across resistor 78 causing transistor 76 to conduct even harder. The negative current from battery 75 also is used to charge capacitor 79 which is negative with respect to the emitter of transistor 76, further aiding the conduction of the transistor. As the current passes through the primary 80 of transformer 81, capacitor 79 is caused to discharge thereby turning off transistor 76. Capacitor 79 then recharges turning transistor 76 back on and in this manner, the primary creates the effect of A.C. in the secondary 82 which is rectified by capacitor 83 and diode 84. The arrangement of capacitors 87 and 88 and diodes 89 and 90 act as multipliers of the recitified voltage output.

The resultant voltage developed cross terminals 91 and 92, in a relatively brief time interval, such as 5 seconds, is between 1,200 and 1,500 volts D.C. and these terminals, one being hot and the other being at a near ground potential, are coupled to prongs 61 and 62 by conductors 69 and 70, respectively. Battery 75 may be, for example, two, series coupled, AAA penlite alkaline batteries providing approximately 3.0 volts D.C. The transformer may have, for example, a 1,100 turn secondary, a 20 turn primary, a 10 turn feedback coil 77 and an iron ferrite core. Light 50 is a light-emitting diode coupled in series with resistor 85 and illuminates when momentary switch **85*a* is closed in order to identify when the power level of the battery is too low to deliver the requisite shock. The pushbutton contact 85*b* for switch 85*a* extends through opening 85*c* in top section 33 (see FIGS. 3 and 5) for manual actuation of switch 85*a***.

The various electrical components utilized to fabricate high-voltage circuit 74 are of a standard design as well as being of conventional values and tolerances. The precise selection of components is a matter of some choice based upon the total arrangement and modifications to the basic circuit are envisioned which would still permit the low to high voltage step-up by other means. Also, the network of diodes and capacitors may be extended in a like manner such that depending upon the value of the components selected, the upper limit of the voltage shock can be adjusted either upwardly or downwardly from the 1,200 to 1,500 volt level previously mentioned.

Apparatus 20 has two primary methods of use, one of which involves a short turn-on interval and the other of which involves a constantly-on condition. Once the high-voltage circuit 74 has been turned on for approximately 5 seconds, the charge across terminals 91 and 92, and thus across prongs 61 and 62, will be fully developed to its maximum level (1,500 volts) and this potential will remain in a ready condition until the prongs are discharged by touching someone or by touching an electrically conductive surface. This method will prevent inadvertent shock once the apparatus is initially discharged, but the apparatus is also unavailable to deliver a second shock unless it is first turned back on and held for the required 5-second interval. The other method of use is to turn on apparatus 20 and leave it on such that shock after shock can be delivered rapidly by touching and releasing in alternating sequence. The point to remember with this method is that you must turn the apparatus off and then discharge the unit in order to prevent inadvertent shock.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A self-defense apparatus to be worn by the user which comprises:

a self-contained, high-voltage-producing module securable to a hand of the user; and a finger probe device electrically coupled to said high-voltage-producing module and suitably arranged to be worn on a finger of said hand, said finger probe device including a pair of electrically conductive prongs and a layer of electrical insulating material disposed between said finger and said pair of prongs, said prongs being designed and arranged into a pointed configuration and outwardly protruding from said layer a distance sufficient to enable said prongs to penetrate at least one layer of clothing.

2. The apparatus of claim 1 wherein with said finger probe device attached to said finger, said two outwardly protruding prongs being disposed adjacent the distal end of said finger.

3. The apparatus of claim 2 wherein one of said two prongs couples to the hot side of said high-voltage-producing module and the other one of said two prongs couples to the ground side of said high-voltage-producing module, said two prongs capable of carrying and holding a potential difference of at least 1,200 volts D.C.

4. The apparatus of claim 3 wherein said high-voltage-producing module being designed and arranged to provide a potential difference of at least 1,200 volts D.C.

5. The apparatus of claim 2 wherein said two prongs are substantially parallel to each other and are spaced apart by a distance of between 0.20 and 0.30 inches.

6. The apparatus of claim 1 wherein said high-voltage-producing module being designed and arranged to provide a potential difference of at least 1,200 volts D.C.

7. The apparatus of claim 6 wherein said high-voltage-producing module comprises:

a source of low voltage;

a transformer coupled to said source of low voltage; and voltage multiplier means coupled to said transformer.

8. The apparatus of claim 7 wherein said source of low voltage includes a battery arrangement rated at between 2.5 and 3.5 volts D.C.

9. A self-defense apparatus to be worn by the user which comprises:

a source of high voltage;

a cannister of repellant having a spray pushbutton and being suitably arranged to deliver a spray of said repellant in response to depression of said pushbutton; and a finger probe device electrically coupled to said source of high voltage, said finger probe device comprising:

means for attaching said finger probe device to a finger; and two electrically conductive, outwardly protruding prongs, said two outwardly protruding prongs being disposed adjacent the distal end of said finger, one of said prongs coupling to the hot side of said source of high voltage and the other one of said two prongs coupling to the ground side of said source of high voltage, said two prongs being capable of carrying and holding a potential difference of at least 1,200 volts D.C.

10. A self-defense apparatus to be worn by the user which comprises:

a source of high voltage;

a cannister of repellant having a spray pushbutton and being suitably arranged to deliver a spray of said repellant in response to depression of said pushbutton; and a finger probe device electrically coupled to said source of high voltage, said finger probe device comprising:

means for attaching said finger probe device to a finger; and two electrically conductive, outwardly protruding prongs.

* * * * *